United States Patent [19]

Morris

[11] 3,972,289

[45] Aug. 3, 1976

[54] TEMPERATURE-SENSITIVE DISARMING ELEMENT

[75] Inventor: Charles W. Morris, Bartlesville, Okla.

[73] Assignee: The United States of America as represented by the Secretary of the Navy, Washington, D.C.

[22] Filed: Apr. 4, 1975

[21] Appl. No.: 565,041

[52] U.S. Cl. ..... 102/70 R; 102/1 R; 102/105; 169/57

[51] Int. Cl.[2] ..... F42C 19/02

[58] Field of Search ..... 102/70 R, 70 AC, 56 R, 102/49.4, 49.6, 1 R, 105; 86/1 R; 169/42, 57

[56] References Cited

UNITED STATES PATENTS

| | | | |
|---|---|---|---|
| 3,106,162 | 10/1963 | Hagerty | 102/49.4 UX |
| 3,173,364 | 3/1965 | Nordzell | 102/56 X |
| 3,246,432 | 4/1966 | Young | 169/42 X |
| 3,401,632 | 9/1968 | Griffith et al. | 102/24 R |
| 3,654,996 | 4/1972 | Naglowsky | 169/42 X |
| 3,665,857 | 5/1972 | Radnich et al. | 102/1 R |
| 3,713,360 | 1/1973 | Shansey | 102/24 R X |
| 3,779,318 | 12/1973 | Livingston | 169/42 X |
| 3,782,475 | 1/1974 | Schmidt | 169/57 X |

*Primary Examiner*—David H. Brown
*Attorney, Agent, or Firm*—R. Sciascia; R. Beers; S. Sheinbein

[57] ABSTRACT

A temperature-sensitive disarming element for a warhead comprising a retaining ring for the detonation-lead positioning cup. The retaining ring is made from a material whose characteristic is that its mechanical strength degrades rapidly at a temperature of about 250°–300°F. so that it permits the positioning cup to be blown off in a flame environment. This prevents pressure buildup in the warhead charge, which would lead to detonation of the warhead.

2 Claims, 3 Drawing Figures

FIG. 3
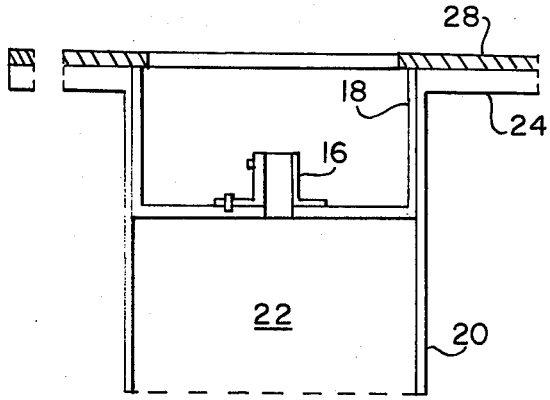
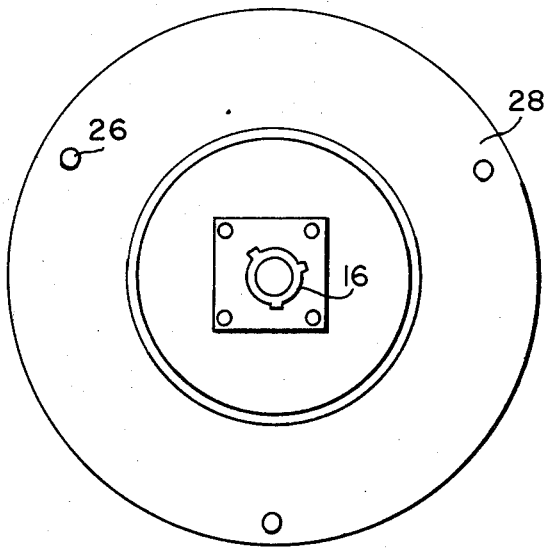
FIG. 2

TEMPERATURE-SENSITIVE DISARMING ELEMENT

BACKGROUND OF THE INVENTION

This invention relates to a temperature-sensitive disarming element and especially to a temperature-degradable element for making a warhead explosive charge safe from detonation in case of fire.

One of the foremost safety problems in the operation of warships, or other facilities for storing bombs, explosive missiles, and the like, is the prevention of ordnance "cookoff" when exposed to a fire. The fast cookoff characteristics of most missiles indicate that a high-order reaction of the warhead is probable. At present, missiles have no flame safety mechanism built into the systems.

SUMMARY OF THE INVENTION

The invention comprises a retaining ring which is placed on the booster charge cup on the cover plate of a warhead. The ring is made of thermally degradable material which degrades rapidly in mechanical strength in the presence of elevated temperatures, thus allowing the booster charge cup to be blown off thereby decreasing pressure buildup in the warhead charge.

An object of this invention is to prevent high-order reactions in the explosive components of a warhead when it is exposed to a fire.

Other objects, advantages and novel features of the present invention will become apparent from the following detailed description of the invention when considered in conjunction with the accompanying drawing.

BRIEF DESCRIPTION OF THE DRAWING

FIG. 2 is a top view of a retaining ring and its relation to the connector for the detonation lead.

FIG. 3 is a cross-sectional side view showing the relationships between the sealing cup, detonation lead position cup and retaining ring.

DETAILED DESCRIPTION OF THE INVENTION

Figure 1:
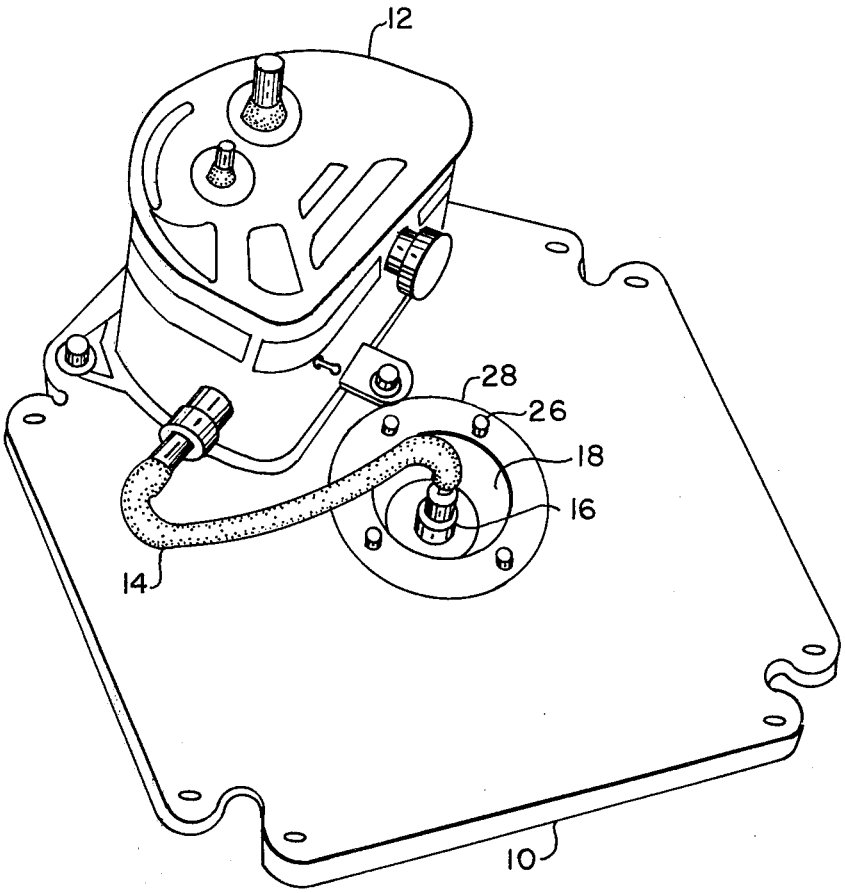
FIG. 1 is an isometric view of the aft cover plate of a typical missile warhead.

In a typical missile warhead system, the aft face of the warhead has a cover plate 10 (see FIG. 1) which supports a fuze 12 connected to some means (not shown) for actuating the fuze. A flexible detonation lead 14 extends from the fuze 12 to a connector 16 which leads to the booster charge (not shown) below. The connector 16 is supported by a detonation-lead positioning cup 18 (see FIGS. 2 and 3) which, is enclosed by a tubular sealing cup 20. Part of the sealing cup 20 extends below the detonation cup 18 forming a space 22 enclosed on the top and the sides in which the booster charge sits on top of the warhead explosive charge. The sealing cup 20 is formed with an outwardly extending flange 24 around its upper end. The positioning cup and the sealing cup 20 may, together, be called the containing means for the booster charge. The containing means may, of course, be formed as a single, unitary means.

Affixed to the top of the flange 24, preferably although not necessarily by bolts 26, is retaining ring 28. This ring is preferably made any thermally degradable material such as high-density polypropylene or polyethylene, or low-density metallic alloys such as Cerrocast which is a bismuth-tin alloy or Cerromatrix which is a bismuth-tin-lead alloy. Any material may be used which degrades rapidly in mechanical strength in the 250°–300°F. temperature range and satisfies all the original design requirements of the hardware, including strength and compatibility with the explosive, may be employed.

When a fire starts in the vicinity of a warhead, pressure starts to build-up in the explosive charge. However, before sufficient build-up of pressure occurs to detonate the explosive charge, the retaining ring material degrades in mechanical strength to a point where the detonation-lead positioning cup 18 is blown upwards through the part of the retaining ring which covers its sides. The sealing cup 20 may also be blown off. This releases the gases causing the pressure build-up and allows the explosive charge to burn rather than to explode, since the containment of an explosive at elevated temperatures is a direct cause of detonation.

Other configurations are possible. For example, the retaining ring may be made of degradable material only in the area immediately above the sides of the positioning cup 18, or the positioning cup and retaining ring may be formed in a single piece from degradable material.

Obviously, many modifications and variations of the present invention are possible in light of the above teachings. It is therefore to be understood that, within the scope of the appended claims, the invention may be practiced otherwise than as specifically described.

What is claimed is:

1. A system for preventing accidental detonation of a warhead charge due to fire comprising:

means for containing the booster charge of said warhead;

a retaining ring placed over at least part of said containing means so as to hold the latter in place, at least that part of said retaining ring which covers said containing means being fabricated from a material whose mechanical strength degrades rapidly in a hot environment;

whereby if a fire occurs in the vicinity of said warhead said retaining ring would degrade, enabling said containing means to break away from said booster charge, thereby preventing detonation of said warhead.

2. A system as recited in claim 1 wherein said containing means comprises a detonation positioning cup and a sealing cup, and wherein said hot environment comprises temperatures between 250° to 300° fahrenheit.

* * * * *